US009869122B2

(12) United States Patent
Isaacs et al.

(10) Patent No.: US 9,869,122 B2
(45) Date of Patent: Jan. 16, 2018

(54) CORNERLOCK HAVING A SELF CONFIGURABLE FIRST BODY MEMBER

(71) Applicant: Quanex Corporation, Houston, TX (US)

(72) Inventors: Joseph D. Isaacs, Cameron, WI (US); Ronald J. Pich, Cameron, WI (US); Brian Jensen, Cameron, WI (US); Jacob D. Pichler, Almena, WI (US); Scott M. Fetting, Rice Lake, WI (US)

(73) Assignee: QUANEX CORPORATION, Houston, TX (US)

( * ) Notice: Subject to any disclaimer, the term of this patent is extended or adjusted under 35 U.S.C. 154(b) by 0 days.

(21) Appl. No.: 15/010,958

(22) Filed: Jan. 29, 2016

(65) Prior Publication Data

US 2017/0218680 A1 Aug. 3, 2017

(51) Int. Cl.
*E06B 1/12* (2006.01)
*E06B 1/32* (2006.01)
(Continued)

(52) U.S. Cl.
CPC ..... *E06B 1/12* (2013.01); *E06B 1/32* (2013.01); *E06B 3/9725* (2013.01); *F24B 1/192* (2013.01)

(58) Field of Classification Search
CPC . E06B 1/12; E06B 3/9725; E06B 1/32; F24B 1/193
See application file for complete search history.

(56) References Cited

U.S. PATENT DOCUMENTS 2,188,209 A 1/1940 Sharp
2,989,788 A 6/1961 Kessler
(Continued)

FOREIGN PATENT DOCUMENTS

CH 352125 A 2/1961
CH 617990 A5 6/1980
(Continued)

OTHER PUBLICATIONS

Amazon, "15759 Pella", downloaded on Aug. 12, 2014 from http://www.amazon.com/prime-prod-PL 15759-screen-corner/dp, 1 page.

(Continued)

*Primary Examiner* — Jeanette E Chapman
(74) *Attorney, Agent, or Firm* — Howard & Howard Attorneys PLLC

(57) ABSTRACT

A cornerlock is used with a frame assembly. The frame assembly includes first and second frame members each having walls defining interior voids. The cornerlock extends into the interior void of each of the first and second frame members. The cornerlock comprises first and second body members mating with the interior voids of the first and second frame members, respectively. Each body member has proximal and distal ends and are rigidly fixed to one another. The first body member has a leg and an arm both extending from the proximal end to the distal end. The leg is resistant to deflection. The arm is deflectable about the proximal end and immediately deflects upon engagement with the first frame member for engaging the leg with one of the plurality of walls and biasing the arm into engagement with another one of the plurality of walls of the first frame member.

23 Claims, 12 Drawing Sheets

(51) Int. Cl.

| | |
|---|---|
| ***E06B 3/976*** | (2006.01) |
| ***E06B 3/972*** | (2006.01) |
| ***F24B 1/192*** | (2006.01) |

(56) References Cited

U.S. PATENT DOCUMENTS

| | | | | |
|---|---|---|---|---|
| 2,996,159 | A * | 8/1961 | Casebolt | E06B 3/9725 403/280 |
| 3,183,560 | A | 5/1965 | Brichard | |
| 3,317,227 | A | 5/1967 | Nijhuis | |
| 3,321,223 | A | 5/1967 | Snow et al. | |
| 3,346,310 | A * | 10/1967 | Diack | A47B 47/0008 312/114 |
| 3,351,367 | A * | 11/1967 | Beckman | E06B 3/9765 29/509 |
| 3,485,519 | A | 12/1969 | Chiu | |
| 3,579,724 | A | 5/1971 | Toth | |
| 3,606,419 | A | 9/1971 | Virkler et al. | |
| 3,688,459 | A | 9/1972 | Mattix | |
| 3,709,533 | A * | 1/1973 | Walters | E05D 15/0647 160/381 |
| 3,782,054 | A | 1/1974 | Goss, Jr. | |
| 3,826,053 | A | 7/1974 | Cameron | |
| 3,866,380 | A | 2/1975 | Benson | |
| 3,899,258 | A | 8/1975 | Matthews | |
| 4,106,476 | A * | 8/1978 | Harsha | F24B 1/192 126/547 |
| 4,222,209 | A | 9/1980 | Peterson | |
| D267,764 | S | 2/1983 | Sundberg | |
| 4,452,138 | A | 6/1984 | Bubley et al. | |
| 4,530,195 | A | 7/1985 | Leopold | |
| 4,683,634 | A | 8/1987 | Cole | |
| D317,400 | S | 6/1991 | Loew | |
| 5,048,997 | A | 9/1991 | Peterson | |
| 5,154,034 | A | 10/1992 | Stanek | |
| 5,378,077 | A | 1/1995 | Paulsen | |
| 5,380,119 | A | 1/1995 | Hadden | |
| 5,431,211 | A | 7/1995 | Guillemet | |
| 5,473,853 | A | 12/1995 | Guillemet et al. | |
| 5,485,705 | A | 1/1996 | Guillemet | |
| 5,564,758 | A | 10/1996 | Tiberio | |
| 6,108,997 | A | 8/2000 | Blais et al. | |
| 6,332,657 | B1 | 12/2001 | Fischer | |
| 6,406,213 | B1 | 6/2002 | Dohman et al. | |
| 6,672,365 | B2 | 1/2004 | Therrien | |
| 7,708,322 | B2 | 5/2010 | Timothy et al. | |
| 7,806,620 | B1 | 10/2010 | Brochez | |
| 8,528,293 | B2 | 9/2013 | Sawyers et al. | |
| 8,532,245 | B2 | 9/2013 | Gilmore et al. | |
| 8,572,925 | B2 | 11/2013 | Sawyers et al. | |
| 8,636,437 | B2 | 1/2014 | Therrien | |
| 8,763,342 | B2 | 7/2014 | Tseng | |
| 8,851,787 | B2 | 10/2014 | Kelley et al. | |
| 2003/0135073 | A1* | 7/2003 | Zhu | C07C 45/85 568/433 |
| 2004/0035082 | A1 | 2/2004 | Hudoba et al. | |
| 2004/0088943 | A1 | 5/2004 | Kronenberg | |
| 2005/0006038 | A1* | 1/2005 | Armstrong | E06B 39/52 160/371 |
| 2007/0297854 | A1 | 12/2007 | Ohrstrom | |
| 2008/0072517 | A1 | 3/2008 | Grazioso | |
| 2010/0242400 | A1 | 9/2010 | Sawyers et al. | |
| 2011/0073723 | A1 | 3/2011 | Ashpole | |
| 2011/0194886 | A1 | 8/2011 | Wu et al. | |
| 2011/0258897 | A1* | 10/2011 | Dorsey | A47G 1/10 40/780 |
| 2012/0269570 | A1 | 10/2012 | Felber | |
| 2014/0318049 | A1 | 10/2014 | Paquet et al. | |

FOREIGN PATENT DOCUMENTS

| | | | | |
|---|---|---|---|---|
| DE | 2456285 | A1 * | 8/1976 | E06B 3/9682 |
| DE | 2 627 401 | A1 | 12/1977 | |
| DE | 20 002 578 | U1 | 7/2000 | |
| DE | 102007013264 | A1 * | 10/2008 | E06B 3/9725 |
| EP | 2 479 373 | A2 | 7/2012 | |
| EP | 2479373 | A2 * | 7/2012 | E06B 3/9725 |
| EP | 2868856 | A3 * | 8/2015 | E06B 3/9682 |
| FR | 2 556 402 | A1 | 6/1985 | |

OTHER PUBLICATIONS

Amazon, "Products PL 8096", downloaded on Aug. 12, 2014 from http://www.amazon.com/prime-line-products-PL-8096-plastic/dp, 1 page.

Amazon, "Prime-Line Products PL 7725 Screen 7/16-Inch by 3/4-Inch", downloaded on Aug. 12, 2014 from http://www.amazon.com/slide-co-PL-7724-screen-corner/dp, 1 page.

Connecticut Screen Works Inc., "Screen Wall System Swivel Corner Insert", downloaded on Aug. 12, 2014 from http://www.mcssl.com/store/connscreen/screen-wall-system, 2 pages.

Direct Industry, "Tube Connector-SR", downloaded on Aug. 12, 2014 from http://www.directindustry.com/prod/essentra-components/tube-connector, 1 page.

Glass Distributors, Inc., "Sliding Screen Door Corner Insert—B569", downloaded from https:/www.glassdistributorsinc.com/sliding-screen-door-corner-insert on Mar. 9, 2015, 2 pages.

Reflect Window, "Sliding Patio Screen door 3/8" Wide Die Cast Corner Insert", downloaded on Aug. 12, 2014 from http://www.reflectwindow.com/sliding-patio-screen-door-3-8-inch, 1 page.

Swisco, "Adjustable Miter-Cut Screen", downloaded on Aug. 12, 2014 from http://www.swisco.com/adjustable-miter-cut/pd/corner-keys-for-7-16-inch, 1 page.

Wholesale Screen and Glass, "1"x7/16" Adjustable Corner", downloaded on Aug. 12, 2014 from http://wholesalescreenandglass.com/adjustable-screen-frame, 1 page.

U.S. Appl. No. 14/731,723, filed Jun. 5, 2015, 47 pages.

English language abstract and machine-assisted English translation for CH 352125 extracted from espacenet.com database on Jul. 10, 2016, 8 pages.

English language abstract and machine-assisted English translation for CH 617990 extracted from espacenet.com database on Jul. 10, 2016, 10 pages.

English language abstract and machine-assisted English translation for DE 2 627 401 extracted from espacenet.com database on Jul. 10, 2016, 12 pages.

English language abstract and machine-assisted English translation for DE 20 002 578 extracted from espacenet.com database on Jul. 10, 2016, 12 pages.

English language abstract and machine-assisted English translation for FR 2 556 402 extracted from espacenet.com database on Jul. 10, 2016, 6 pages.

* cited by examiner

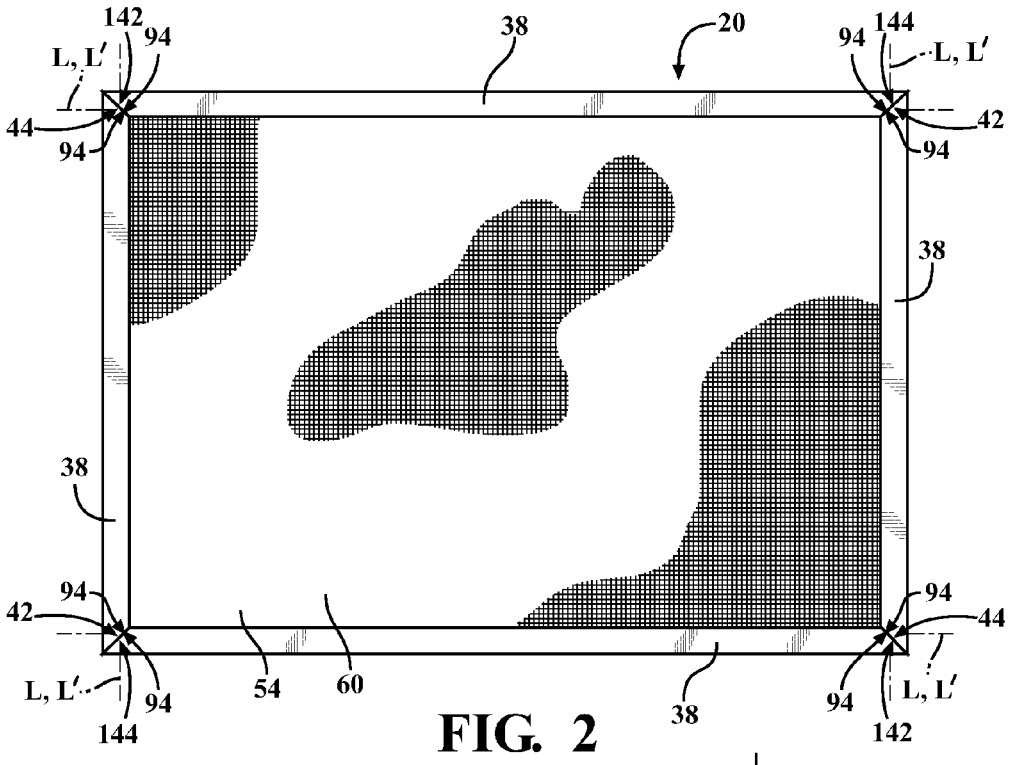
FIG. 2
FIG. 3A
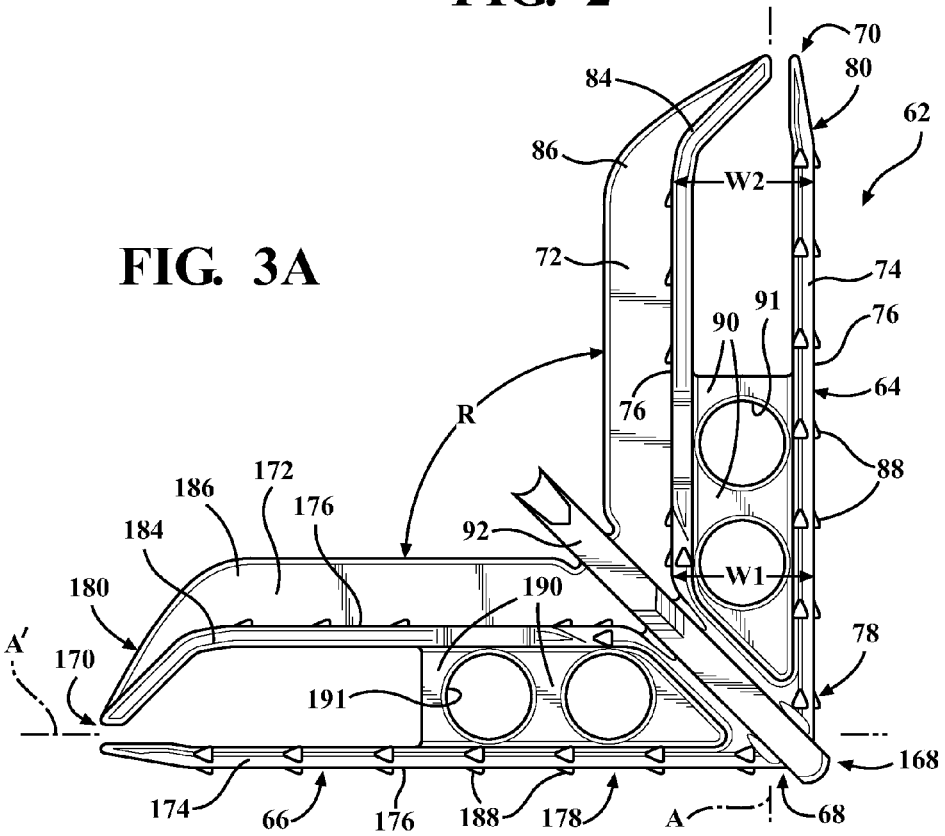

FIG. 3B
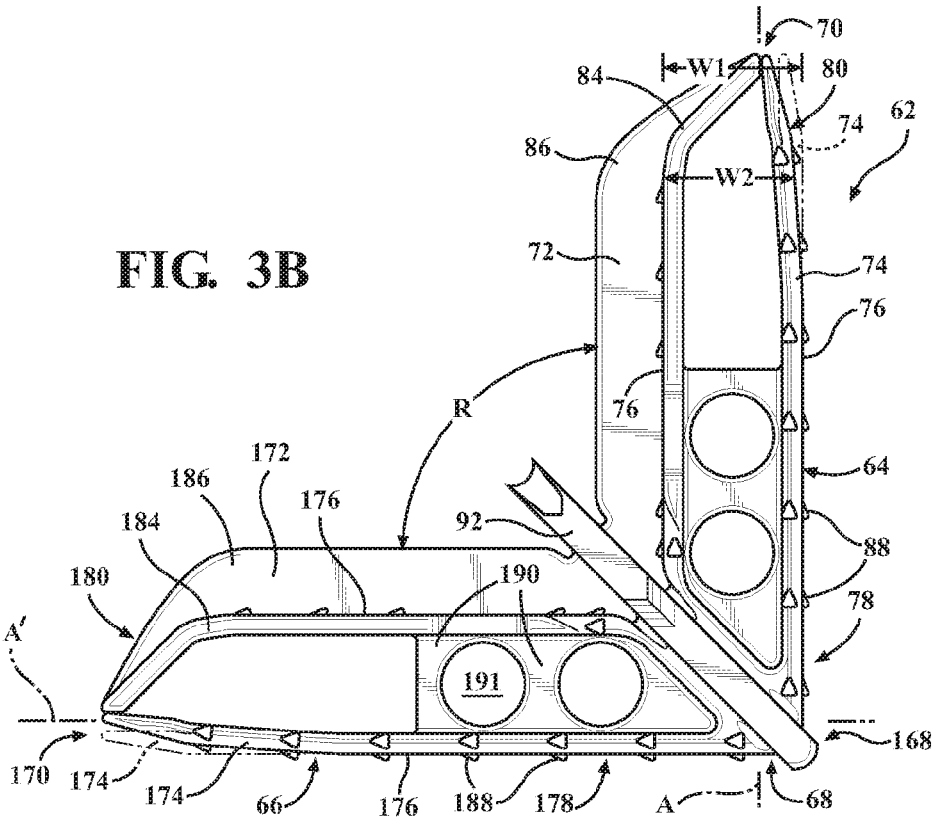
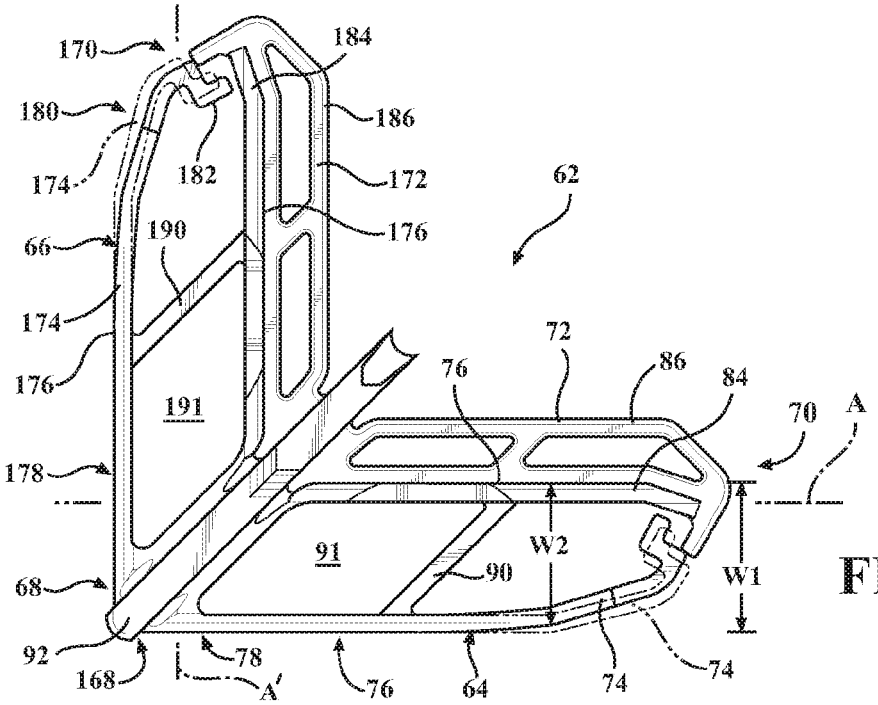
FIG. 10B

CORNERLOCK HAVING A SELF CONFIGURABLE FIRST BODY MEMBER

BACKGROUND OF THE INVENTION

1. Field of the Invention

The subject invention relates to a cornerlock for use with a frame assembly, with the cornerlock having a leg resistant to deflection and an arm which is deflectable.

2. Description of Related Art

Cornerlocks are used with frame assemblies to couple together frame members of the frame assemblies. The frame assembly includes frame members each having first and second ends, with each defining an interior and a screen mounted to the frame members. Certain cornerlocks include locking members fixed to one another. One of the locking members is inserted into the interior of one of the frame members. Another one of the locking members is inserted into the interior of another one of the frame members. The locking members frictionally engage the frame members. If the locking members are too large to be inserted into the frame members or if the locking members do not frictionally engage the frame members, the locking members must be manipulated, typically by force, to facilitate insertion and frictional engagement with the frame members. The manipulation required to couple the locking members of the cornerlock with the frame members requires skill and labor which increases the time required to manufacture the frame assembly. As such, there remains a need to provide an improved frame assembly and cornerlock.

SUMMARY OF THE INVENTION AND ADVANTAGES

The subject invention provides a cornerlock for use with a frame assembly. The frame assembly includes a first frame member and a second frame member each having a plurality of walls extending between a first end and a second end which is spaced from the first end. The plurality of walls of each of the first and second frame members defines an interior void. The cornerlock is configured to extend into the interior void of each of the first and second frame members. The cornerlock comprises a first body member configured to mate with the interior void of the first frame member and a second body member configured to mate with the interior void of the second frame member. Each body member has a proximal end and a distal end spaced from the proximal end with the first and second body members rigidly fixed to one another at the proximal ends;

The first body member has a leg extending from the proximal end to the distal end with the leg resistant to deflection. The first body member also has an arm spaced from the leg and extending from the proximal end to the distal end. The arm is deflectable about the proximal end, and is configured to immediately deflect upon engagement with the first frame member for engaging the leg with one of the plurality of walls and biasing the arm into engagement with another one of the plurality of walls of the first frame member within the interior void of the first frame member such that the first body member self-configures to the first frame member.

Accordingly, the deflection of the arm caused by engagement with the first frame member facilitates the bias exerted by the arm against the first frame member, which increases a frictional force between leg and the arm of the first body member with the first frame member and retains the first body member in the interior void of the first frame member.

Furthermore, the extension of the arm from the proximal end to the distal end promotes movement of the arm at the distal end which facilitates insertion of the first body member into varying cross-sections of the interior void of the first frame member. In addition, the deflection of the arm allows the first body member to self-configure to the cross-section of the first frame member, which simplifies the skill and labor needed to assemble the frame assembly. Further, the self-configuration of the first body member facilitates retention of the first body member with frame assemblies of all different designs.

BRIEF DESCRIPTION OF THE DRAWINGS

Advantages of the subject invention will be readily appreciated as the same becomes better understood by reference to the following detailed description when considered in connection with the accompanying drawings.

FIG. 2 is an elevational view of the frame assembly showing the frame members and the article.

FIG. 3A is an elevational view of a cornerlock having a first body member and a second body member fixed to the first body member, each having an arm.

FIG. 3B is an elevational view of the cornerlock, shown in FIG. 3A, having the first body member and the second body member fixed to the first body member, with each of the arms deflected.

FIG. 10B is an elevational view of a cornerlock, shown in FIG. 10A, having a first body member and a second body member fixed to the first body member, with each of the arms deflected.

DETAILED DESCRIPTION OF THE INVENTION

Figure 1:
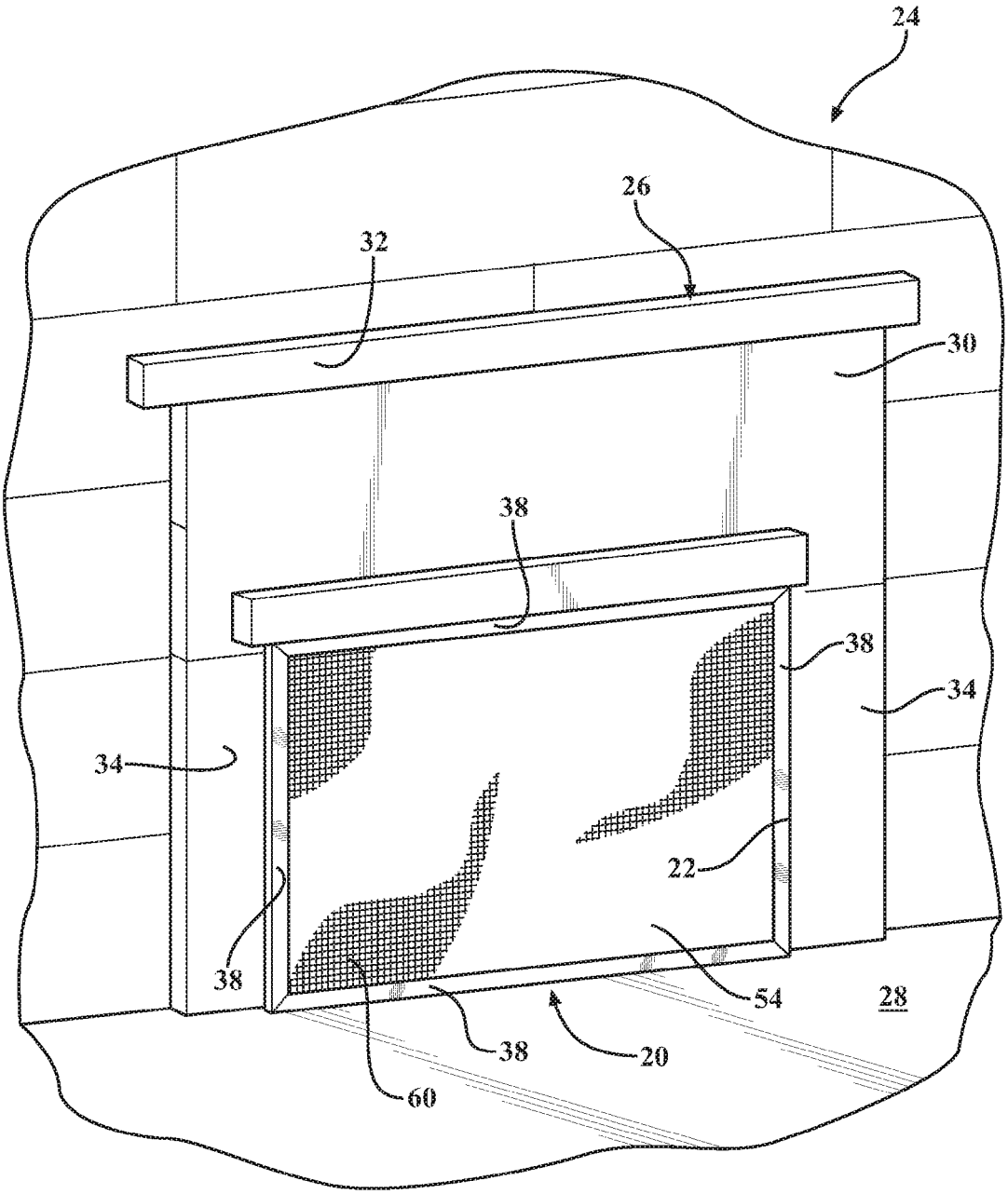
FIG. 1 is a perspective view of a frame assembly in an opening of a structure with the frame assembly showing frame members and an article.

Referring to the Figures, wherein like numerals indicates like or corresponding parts throughout the several views, a frame assembly 20 for disposing within an opening 22 of a structure 24 is generally shown in FIG. 1. The structure 24 is typically a fireplace 26 as shown in FIG. 1 which includes a hearth 28 and a header 30 spaced from and substantially parallel to the hearth 28 with both the hearth 28 and the header 30 extending horizontally in planes transverse to one another. The fireplace 26 further includes a mantel 32 mounted to the header 30 and a pair of legs 34 spaced from and substantially parallel to each other and vertically oriented between the hearth 28 and the header 30. The hearth 28, the header 30, and the pair of legs 34 define the opening 22. The fireplace 26 further includes a firebox positioned between the hearth 28 and the header 30 and between the pair of legs 34. Although not required, the fireplace 26 typically includes a flammable fuel within the firebox such as a timber log, a hydrocarbon gas, or an electric heater each of which emits heat. The fireplace 26 may include a glass panel positioned adjacent to the firebox for inhibiting direct entry into the firebox.

The structure 24 may be a building, such as a commercial or residential building, with the opening 22 providing access into the structure 24, such as a door opening or a window opening. It is also to be appreciated that the structure 24 does not have to be the fireplace 26 and may be any structure 24 having the opening 22.

The frame assembly 20 comprises a first frame member 38*a* and a second frame member 38*b*, as shown in FIG. 2. More specifically, the frame assembly 20 has at least two frame members 38 which include the first and second frame members 38*a*, 38*b*. Typically, the frame assembly 20 comprises more than two frame members 38. The first and second frame members 38*a*, 38*b* refer to two of the frame members 38 which are adjacent to one another. Said differently, the first and second frame members 38*a*, 38*b* may be any two of the frame members 38 that are adjacent to one another. For illustrative purposes, two of the frame members 38 shown in the FIG. 2 are selected to illustrate the first and second frame members 38*a*, 38*b* shown in FIGS. 5-9 and 12-14. It is to be appreciated that any of the frame members 38 shown in the Figures may be referred to as the first and second frame members 38*a*, 38*b*.

Figure 9:
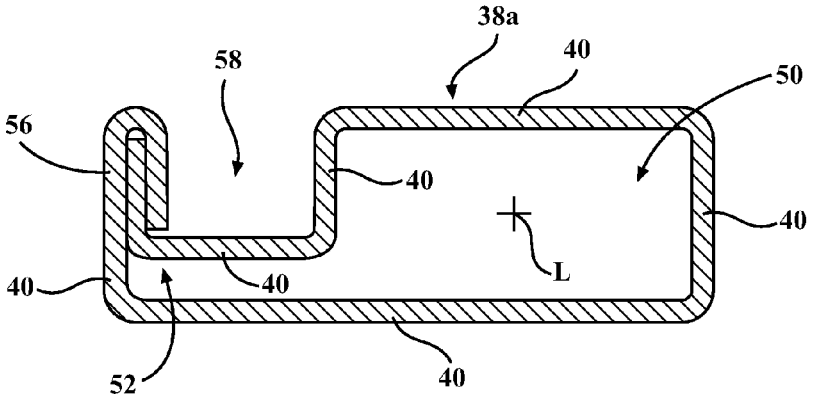
FIG. 9 is a cross-sectional view of the first frame member taken along 9-9 in FIG. 8 showing a cross-section of the first frame member.

As shown in FIGS. 2, 5, 9, and 12, the first and second frame members 38*a*, 38*b* each have a plurality of walls 40, 140 extending between a first end 42, 142 and a second end 44, 144 which is spaced from the first end 42, 142. The first and second frame members 38*a*, 38*b* may have a cross-section between the first end 42, 142 and the second end 44, 144. The plurality of walls 40, 140 of each of the first and second frame members 38*a*, 38*b* define an interior void 48, 148. As such, the plurality of walls 40, 140 may be configured to define the cross-section. The interior void 48 of the first frame member 38*a* may be further defined as a first interior section 50 and a second interior section 52. As shown in FIG. 9, the plurality of walls 40 may be further defined as six walls 40, with four of the walls 40 defining the first interior section 50 and three of the walls 40 defining the second interior section 52. The first and second interior sections 50, 52 may each be partially defined by a common wall 40. It is to be appreciated that the first frame member 38*a* may be comprised of any number of walls 40. The configuration of the first and second interior sections 50, 52 will be better understood by further description below. It is also to be appreciated that the interior void 148 of the second frame member 38*b* may be further defined as a first interior section 150 and a second interior section 152, which will be further described below. The second frame member 38*b* may be configured similarly to the first frame member 38*a* as described above. Therefore, the description of the first frame member 38*a* described herein may be applied to the second frame member 38*b*. Furthermore, components of the second frame member 38*b* that are identical or similar to components of the first frame member 38*a* have the same reference numerals increased by 100.

The cross-section refers to a profile of the frame members 38 as viewed along a longitudinal axis L, L' of the first and second frame members 38*a*, 38*b*, respectively, shown in FIG. 2. Each cross-section is capable of varying between the first and second ends 42, 44, 142, 144. Variations in the cross-sections typically refers to variations of a length of at least one of the plurality of walls 40, 140 and/or a variation in the shape of the plurality walls 40, 140 as viewed along the longitudinal axis L, L'. It is to be appreciated that the cross-section may vary in any particular way.

As shown in FIG. 2, each of the frame members 38 may be positioned sequentially end to end. Furthermore, the first end 42 of the first frame member 38*a* may abut the second end 144 of the second frame member 38*b*. It is to be appreciated that the first end 42 of the first frame member 38*a* may abut the first end 142 of the second frame member 38*b*. Likewise, the second end 44 of the first frame member 38*a* may abut the second end 144 of the second frame member 38*b*. It is to be appreciated that the term "first end" and the term "second end" may be interchangeable and may refer to either end of the frame members 38.

As shown in FIG. 2, the frame members 38 may have a substantially linear configuration. It is to be appreciated the frame members 38 may have an arcuate configuration or any other suitable configuration.

The frame assembly 20 is typically a barrier positioned within the opening 22 for preventing movement of an object through the opening 22. More specifically, as shown in FIGS. 1 and 2, the frame assembly 20 may further comprise an article 54 coupled to and supported by the first and second frame members 38*a*, 38*b*. As shown in FIG. 9, the frame members 38 each may have a lip 56, 156 defining a channel 58, 158 with the article 54 coupled to the frame members 38 within the channel 58, 158. The article 54 coupled to and supported by the first and second frame members 38*a*, 38*b* fills the opening 22 and is a barrier preventing movement of an object through the opening 22. It is to be appreciated that the object may be anything capable of moving through the opening 22 such as an animate object, such as a person or an animal, or an inanimate object, such as a piece of furniture or a child's toy.

When the structure 24 is the fireplace 26 as shown in FIG. 1, the frame assembly 20 is typically positioned within the opening 22 of the fireplace 26. If the fireplace 26 has the glass panel, the glass panel is positioned between the firebox and the frame assembly 20 with the frame assembly 20 spaced from the glass panel. Furthermore, when the structure 24 is the fireplace 26 as shown in FIG. 1, the article 54 is further defined as a screen 60, as shown in FIGS. 1 and 2. The screen 60 allows passage of heat from the flammable fuel out of the firebox through the opening 22. Furthermore, air flows through the screen 60 allowing the screen 60 to dissipate heat better than, for example, the glass panel. As such, the screen 60 has a lower temperature than the flammable fuel and/or the glass panel. Therefore, if the screen 60 is contacted by the object, the object is less likely to incur heat-related damage than if the object contacted the flammable fuel or the glass panel. It is to be appreciated does not have to be the screen 60 and does not have to have heat dissipation properties as described above. Therefore, the article 54 may be any article for coupling to the frame members 38, including glass.

When the structure 24 is the building, the frame assembly 20 including the article 54 prevents passage of the object through the opening 22 into and out of the building. Here, the object may include dirt, insects, animals, persons, etc. It is to be appreciated that the frame assembly 20 may have any configuration for preventing the passage of the object through the opening 22.

As shown in FIGS. 3A-7 and 10A-15B, the frame assembly 20 further comprises a cornerlock 62 for use with the frame assembly 20. The cornerlock 62 extends into the interior void 48, 148 of each of the first and second frame members 38*a*, 38*b* to couple together the first and second frame members 38*a*, 38*b*, as shown in FIGS. 5-7 and 12-14. As described above, the first end 42 of the first frame member 38*a* may abut the second end 144 of the second frame member 38*b*. As such, the cornerlock 62 may extend into the first end 42 of the first frame member 38*a* and into the second end 144 of the second frame member 38*b*. As described above, the terms "first end" and "second end" may be interchangeable on the frame members 38. As also described above, the terms "first frame member" and "second frame member" may refer to any of the frame members 38. As such, the cornerlock 62 may couple any two adjacent frame members 38. Furthermore, the cornerlock 62 may be a plurality of cornerlocks 62 each coupling adjacent frame members 38. It is to be appreciated that the cornerlock 62 may be any number of cornerlocks 62 coupling any of the frame members 38. For the sake of simplicity, only one cornerlock 62 is referred to below for coupling the first and second frame members 38*a*, 38*b*. It is to be appreciated that the description below may be applied to any cornerlock 62 and to any frame member 38.

As shown in FIGS. 3A, 4, 10A, 11, and 15A, the cornerlock 62 comprises a first body member 64 configured to mate with the interior void 48 of the first frame member 38*a*, and a second body member 66 configured to mate with the interior void 148 of the second frame member 38*b*. The first body member 64 may be cantilevered with the first frame member 38*a* and the second body member 66 may be cantilevered with the second frame member 38*b*. Said differently, the first body member 64 may extend into a portion of the interior void 48 of the first frame member 38*a* and the second body member 66 may extend into a portion of the interior void 148 of the second frame member 38*b*.

Each body member 64, 66 has a proximal end 68, 168 and a distal end 70, 170 spaced from the proximal end 68, 168. The first and second body members 64, 66 are rigidly fixed to one another at the proximal ends 68, 168.

The first body member 64 has a leg 72 extending from the proximal end 68 to the distal end 70 with the leg 72 resistant to deflection. The first body member 64 also has an arm 74 spaced from the leg 72 and extending from the proximal end 68 to the distal end 70. The arm 74 is deflectable about the proximal end 68. The arm 74 immediately deflects upon engagement with the first frame member 38*a* to engage the leg 72 with one of the plurality of walls 40 and bias the arm 74 into engagement with another one of the plurality of walls 40 of the first frame member 38*a* within the interior void 48 of the first frame member 38*a* such that the first body member 64 self-configures to the first frame member 38*a*.

The leg 72 being resistant to deflection and the arm 74 deflectable about the proximal end 68 are relative terms. Said differently, the leg 72 is more resistant to deflection than the arm 74. As such, the leg 72 does not have to be completely resistant to deflection. General properties relating to the deflection of the leg 72 and the arm 74 will be described in greater detail below.

Figure 10A:
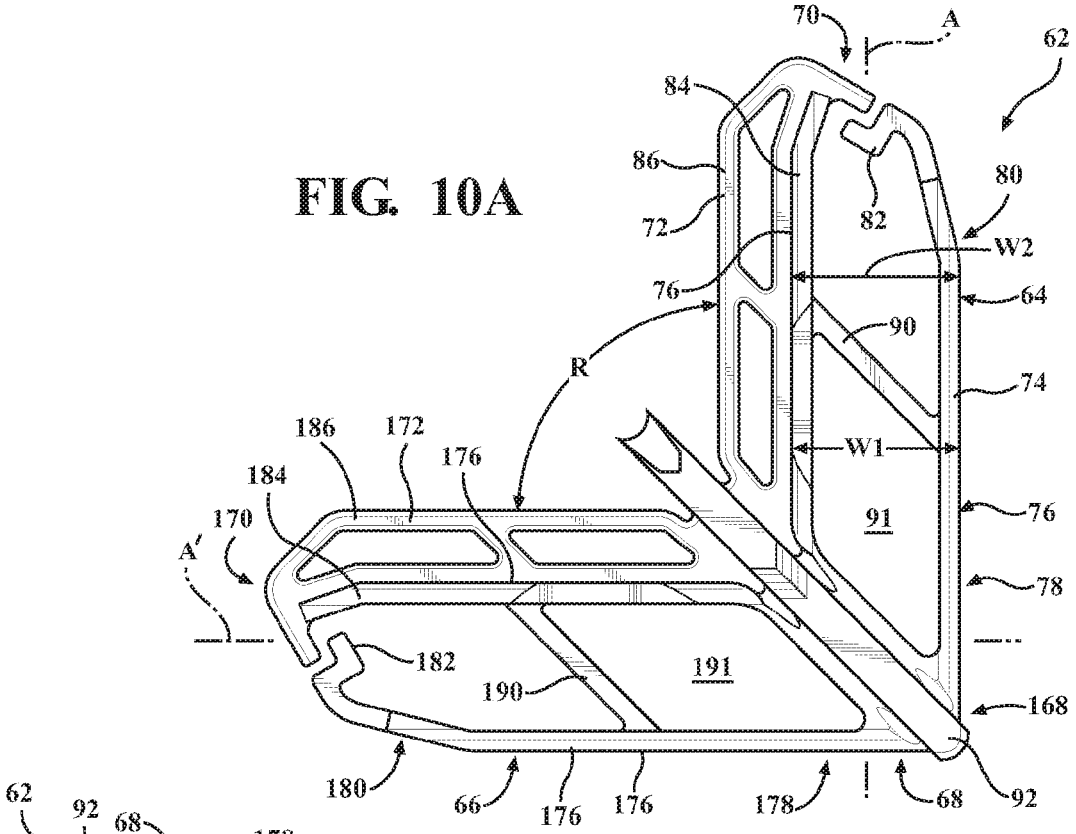
FIG. 10A is an elevational view of a cornerlock having a first body member and a second body member fixed to the first body member, with each of the first and second body members having an arm and a hook.
Figure 15A:
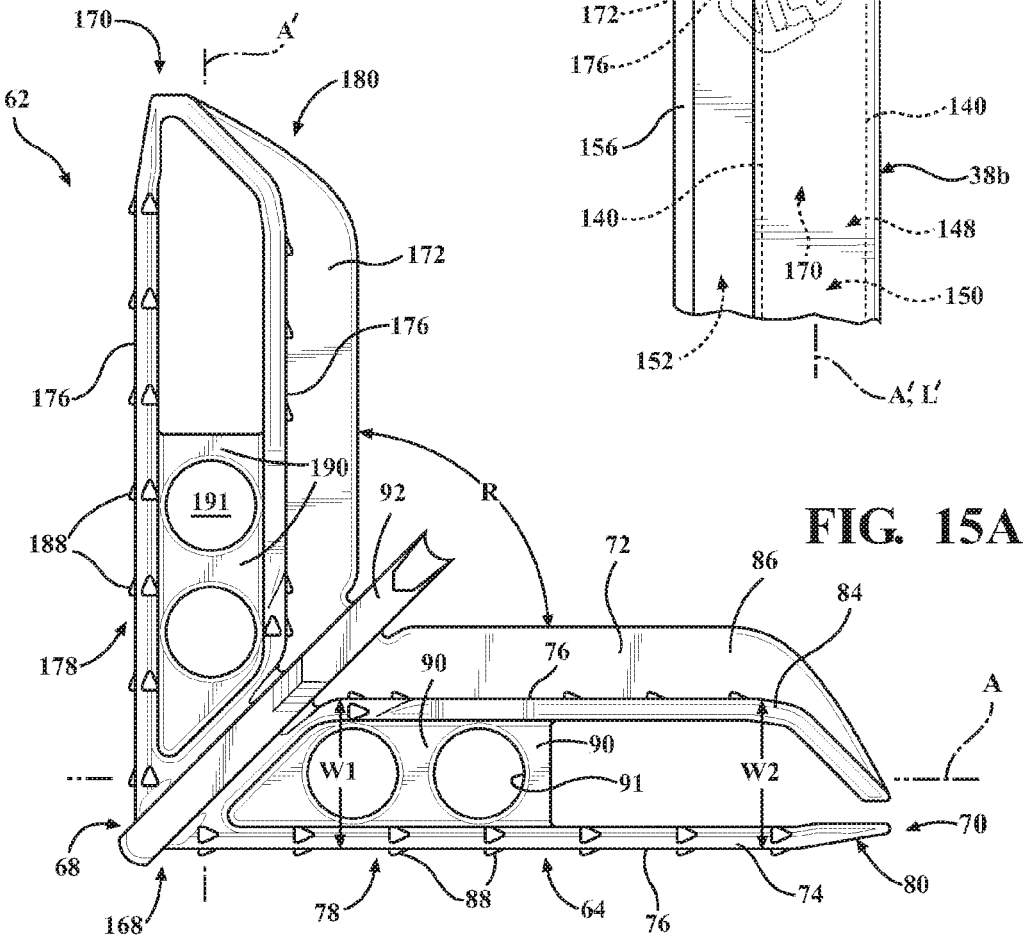
FIG. 15A is an elevational view of a cornerlock having a first body member and a second body member fixed to the first body member, with first body member having a leg and an arm and the second body member having a leg.

As shown in FIGS. 3A, 10A, and 15A, the first and second body members 64, 66 may define an angle R at the proximal ends 68, 168. Said differently, the first and second body members 64, 66 may have an angular configuration with the angle R of the first and second body members 64, 66 defining the angle R between the first and second frame members 38*a*, 38*b*. The angle R may be less than 180 degrees. As shown in the Figures, the angle R may be 90 degrees with four cornerlocks 62 utilized to form a square or rectangular configured frame assembly 20. It is to be appreciated that the angle R may be any suitable degree for facilitating coupling together the first and second frame members 38*a*, 38*b* of the frame assembly 20.

The leg 72 of the first body member 64 may partially define the angle R. Said differently, the angle R may be defined on the side of the first body member 64 which the leg 72 is disposed along. Moreover, the resistance of the leg 72 to deflection helps to maintain the angle R for the first and second body members 64, 66. It is to be appreciated that the angle R may be defined along any suitable side of the first body member 64.

As described above, the first and second body members 64, 66 are rigidly fixed to one another at the proximal ends 68, 168. In one embodiment, the first and second body members 64, 66 are integral such that the cornerlock 62 is a unitary construction. Said differently, the first and second body members 64, 66 are one-piece. One having skill in the art will appreciate that the first and second body members 64, 66 may be two or more components rigidly fixed to one another at the proximal ends 68, 168 by any suitable manner, including, but not limited to, mechanical fasteners and welding.

Typically, the cornerlock 62 is comprised of a metallic material. More typically, the cornerlock 62 is comprised of a die-cast zinc alloy which is able to withstand high temperatures produced by the fireplace 26. It is to be appreciated that the cornerlock 62 may be comprised of other metallic materials, such as aluminum and steel. Furthermore, the cornerlock 62 may be comprised of other materials such as a high-temperature plastic, standard plastic, or any other suitable polymer.

The material of construction is one factor that affects the rigidity of the first and second body members 64, 66. Other factors affecting the rigidity of the first and second body members 64, 66 include, but are not limited to, the thickness of the first and second body members 64, 66, the length of the first and second body members 64, 66, and the area moment of inertia of the first and second body members 64, 66. Various materials have various properties which may affect the structural rigidity of the cornerlock 62, such as the flexural modulus, the modulus of elasticity, the hardness, and the tensile strength. Likewise, the material of construction affects the resistance of the leg 72 to deflection and the deflectability of the arm 74. For example, die-cast zinc alloy may be chosen for being higher in strength than, for example, many polymer materials such as polyvinyl chloride (PVC), which may result in a higher bias exerted by the arm 74. As a non-limiting example, the die-cast zinc alloy may have an elastic modulus of approximately 12,328,200 pounds per square inch (psi), a Poisson ratio of approximately 0.3, and a tensile strength of approximately 41,335 psi. On the other hand, the PVC may have an elastic modulus of approximately 349,540 psi, a Poisson ratio of approximately 0.38, and a tensile strength of approximately 5,900 psi. The higher bias exerted by the arm 74 comprised of the die-cast zinc alloy may be advantageous when the frame members 38 are comprised of comparably high strength material, such as alloy steel. As such, the composition of the cornerlock 62 has a relationship with the bias exerted by the arm 74, which will be described in greater detail below. One having skill in the art will appreciate that the measurements and ratios listed above for the die-cast zinc alloy and the PVC are exemplary in nature and may vary depending on the composition of the die-cast zinc alloy and the PVC. Furthermore, it is to be appreciated that the composition of the cornerlock 62 may be other materials other than the die-cast zinc alloy and the PVC described above.

As shown in FIGS. 3A, 4, 10A, 11, and 15A, each of the leg 72 and the arm 74 may have an engagement surface 76, with the engagement surfaces 76 opposing one another for engaging opposing walls 40 within the interior void 48 of the first frame member 38*a*. The leg 72 and the arm 74 may extend spaced from and substantially parallel to each other between the proximal and distal ends 68, 70 with the arm 74 deflectable toward and away from the leg 72.

As shown in FIGS. 6, 7, 13, and 14, the arm 74 is internally biased away from the leg 72 against the first frame member 38*a* within the interior void 48 and self-configures the first body member 64 to the cross-section of the first frame member 38*a*. Said differently, the leg 72 and the arm 74 engage the walls 40 at at least two points of contact opposing one another. Typically, the leg 72 and the arm 74 each engage opposing walls 40 of the first frame member 38*a*. As such, the deflection of arm 74 corresponds with the engagement of the arm 74 with at least one of the walls 40, which facilitates the bias exerted by the arm 74 opposite the leg 72 and engagement of the leg 72 and the arm 74 with opposing walls 40 of the first frame member 38*a* further increasing the frictional force between the first body member 64 and the first frame member 38*a*. The increased frictional force retains the first body member 64 in the interior void 48 of the first frame member 38*a*. It is to be appreciated that the leg 72 and the arm 74 may engage any of the walls 40 of the first frame member 38*a*.

The arm 74 engages at least one of the walls 40 of the first frame member 38*a* within the interior void 48 and deflects about the proximal end 68 toward an axis A. It is to be appreciated that the arm 74 may deflect about the proximal end 68 toward and away from the axis A.

As shown in FIGS. 3A, 10A, and 15A, the leg 72 and the arm 74 may be tapered toward each other at the distal end 70 for facilitating insertion of the first body member 64 into the interior void 48 of the first frame member 38*a*. Said differently, the leg 72 and the arm 74 extend closer to each other and the axis A further toward the distal end 70. More specifically, each of the leg 72 and the arm 74 may have a proximal portion 78 adjacent the proximal end 68 and a distal portion 80 adjacent the distal end 70 with the proximal portions 78 of the leg 72 and the arm 74 substantially parallel to one another for engaging the walls 40 of the first frame member 38*a*. The distal portions 80 of the leg 72 and the arm 74 may angle toward each other at the distal end 70.

Figure 11:
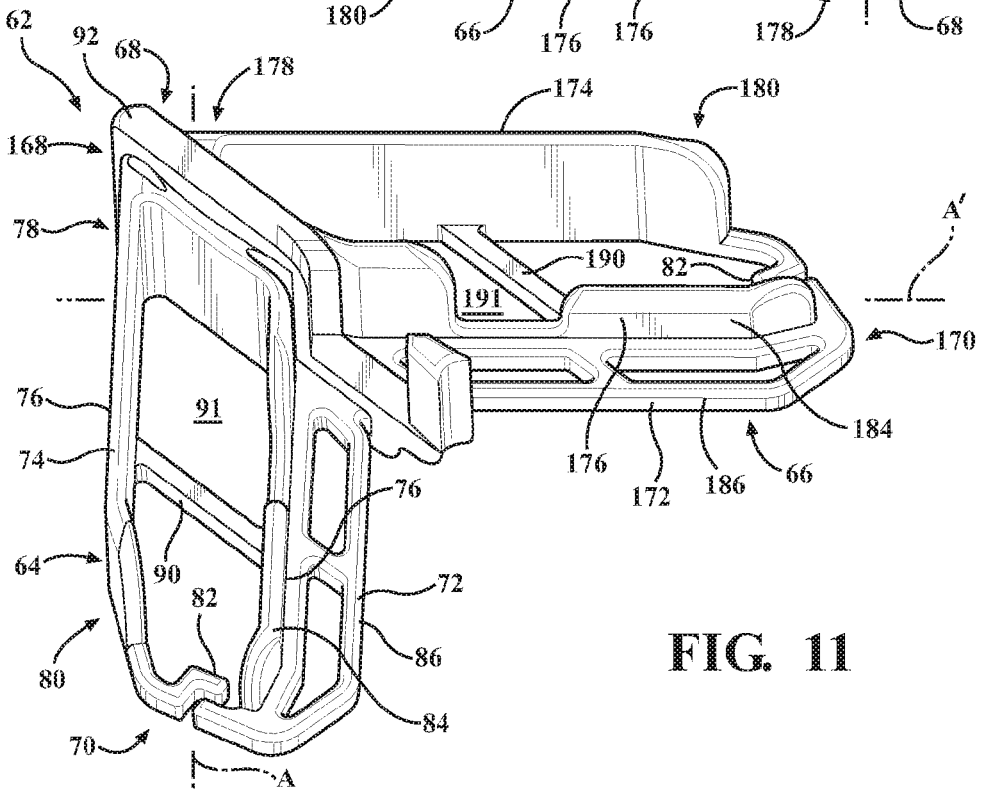
FIG. 11 is perspective view of the cornerlock, shown in FIG. 10A, having the first and second body members.

As shown in FIGS. 10A-11, at least one of the leg 72 and the arm 74 may include a hook 82 at the distal end 70. The arm 74 may have the hook 82 and may extend from the distal end 70 toward the proximal end 68. The hook 82 may engage a hanger during production to hang the cornerlock 62 and facilitate application of a coating (including, but not limited to, paint and powder-coat). It is to be appreciated that the hook 82 may be positioned anywhere on the cornerlock 62.

Figure 14:
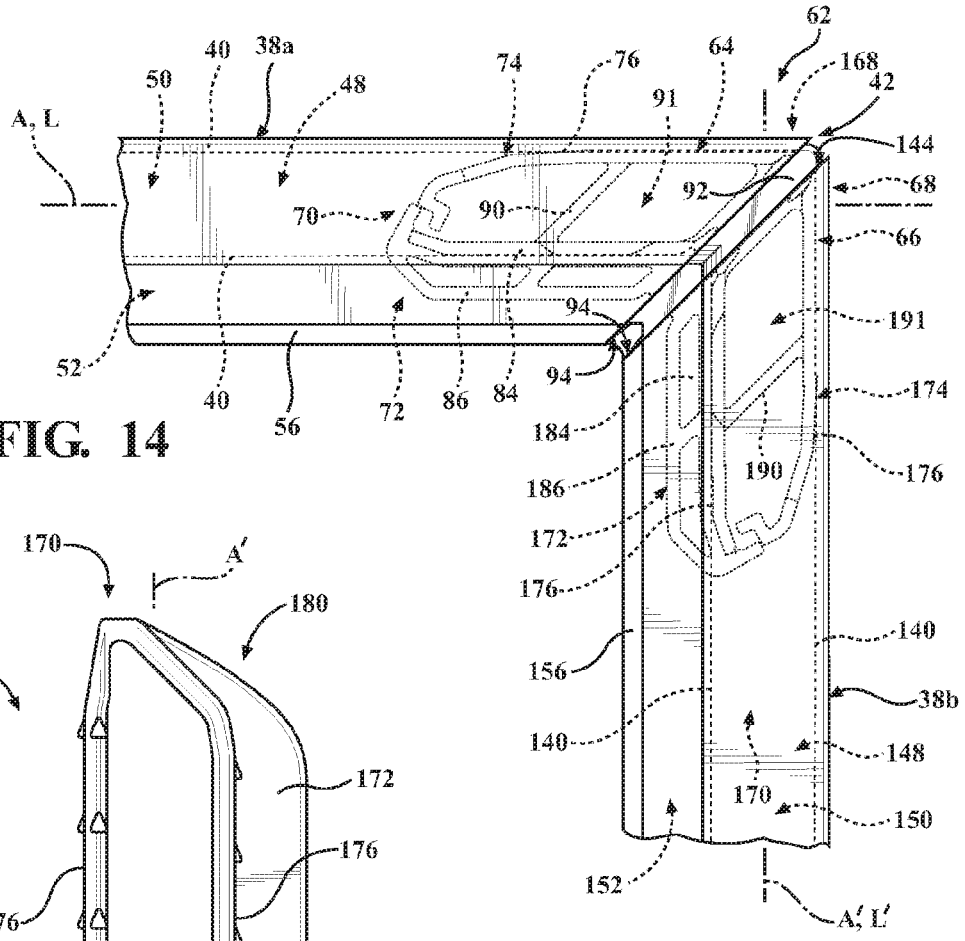
FIG. 14 is an elevational view of the first and second body members of the cornerlock, shown in FIG. 10A, inserted into the interior voids of the first and second frame members and the first and second frame members having mitered ends abutting a center wall of the cornerlock.
Figure 15B:
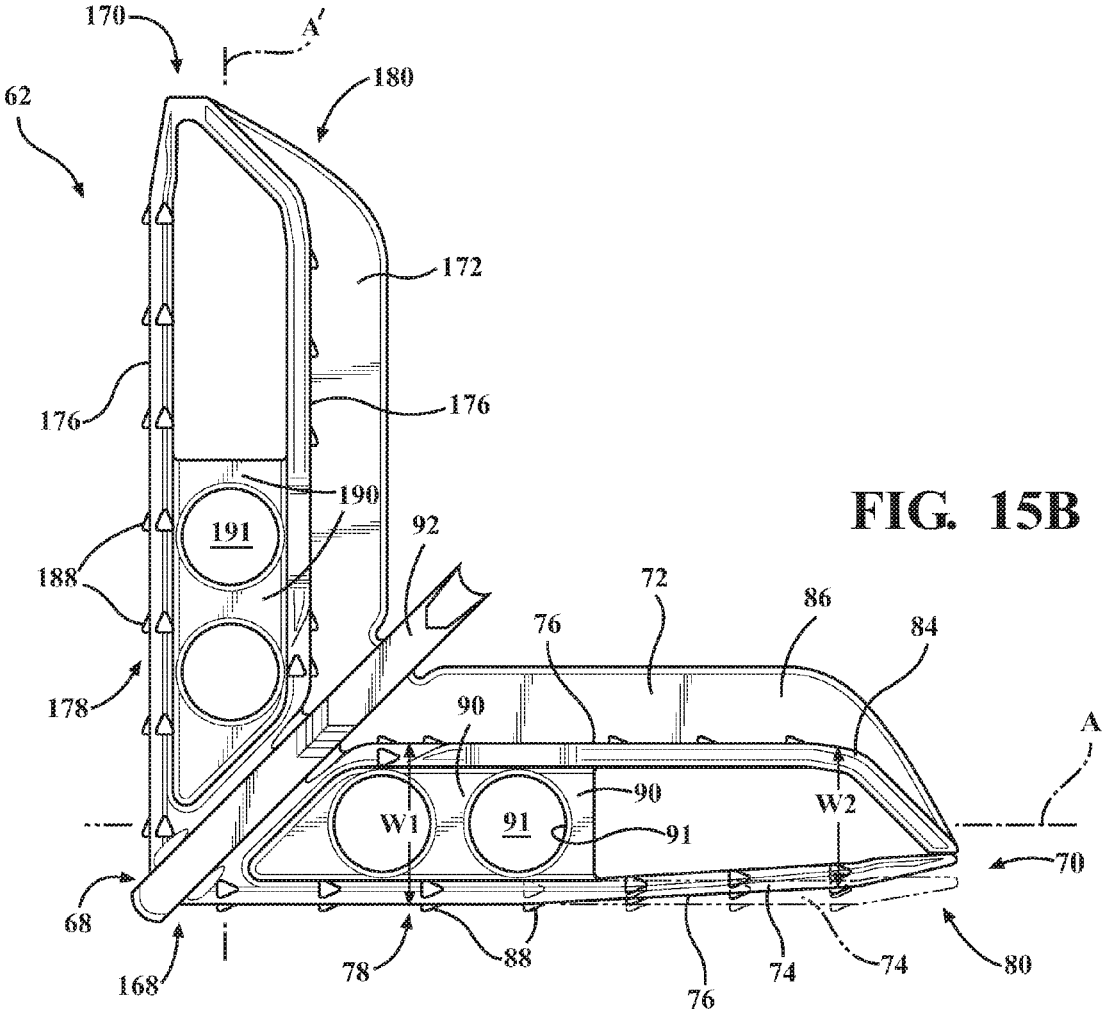
FIG. 15B is an elevational view of the cornerlock, shown in FIG. 15A, having the first body member and the second body member fixed to the first body member, with the arm of the first body member deflected.

As shown in FIGS. 3A, 3B, 10A, 10B, 15A, and 15B, the first body member 64 may have a first width W1 at the proximal end 68 and a second width W2 at the distal end 70, with the second width W2 variable with the deflection of the arm 74 such that the second width W2 is at most equal to the first width W1 for facilitating immediate deflection of the arm 74 upon engagement with the first frame member 38*a*. Said differently, the first width W1 and the second width W2 may be substantially equal before insertion of the first body member 64 into the interior void 48 of the first frame member 38*a*, as shown in FIGS. 3A, 10A, and 15A. The arm 74 deflects about proximal end 68, as shown in FIGS. 3B, 6, 7, 10B, 13, 14, and 15B. As such, the amount of movement of the arm 74 is greater at the distal end 70 than the proximal end 68. The arm 74 may deflect toward the leg 72 as the first body member 64 is inserted into the interior void 48 of the first frame member 38*a*. The greater amount of movement of the arm 74 toward the distal end 70 causes the arm 74 to be closer to the leg 72 at the distal end 70 than at the proximal as first body member 64 during insertion. As such, the first width W1 at the proximal end 68 of the first body member 64 is greater than the second width W2 at the distal end 70 of the first body member 64, as shown in FIGS. 3B, 10B, and 15B. The second width W2 being smaller than the first width W1 facilitates easier insertion of the first body member 64 into the interior void 48 of the first frame member 38*a* while the first body member 64 progressively increases in frictional engagement as the first body member 64 is further inserted toward the proximal end 68, allowing the first body member 64 to custom fit to the first frame member 38*a*. Said differently, the deflectable arm 74 allows easier initial insertion of the first body member 64 into the interior void 48 of the first frame member 38*a* (which may have a varying cross-section as described above) while maintaining a strong frictional engagement of the cornerlock 62 with the first frame member 38*a* upon the completed assembly of the cornerlock 62 with the first frame member 38*a*. It is to be appreciated that the first and second widths W1, W2 may be any suitable length for facilitating easier initial insertion of the first body member 64 into the interior void 48 of the first frame member 38*a*.

As shown in FIGS. 3A, 10A, and 15A, the leg 72 may have a first leg portion 84 and a second leg portion 86 each extending along the axis A between the proximal end 68 and the distal end 70. The first leg portion 84 may have the engagement surface 76 for engaging one of the walls 40 within the interior void 48 of the first frame member 38*a*. Said differently, the engagement surface 76 of the first leg portion 84 may oppose the engagement surface 76 of the arm 74. The first and second leg portions 84, 86 may be integrally formed. The second leg portion 86 may extend from the engagement surface 76 transverse to the axis A to brace the first leg portion 84 such that the leg 72 has a greater resistance to deflection than the arm 74. More specifically, the second leg portion 86 may extend from the engagement surface 76 substantially perpendicular to the first leg portion 84. As such, the first and second leg portions 84, 86 may form a substantially L-shaped configuration along the axis A, and shown in FIGS. 4 and 11. The transverse orientation of the first and second leg portions 84, 86 causes a higher area moment of inertia compared to the arm 74 which typically has a substantially rectangular cross-section along the axis A.

The leg 72 may have a flexural rigidity at least three times greater than a flexural rigidity of the arm 74. Flexural rigidity, as known in the art, refers to the resistance of a structure to bending when a force is exerted thereon. The flexural rigidity of the leg 72 and the arm 74 is a result of numerous factors including, but not limited to, the material of construction, the thickness of the leg 72 and the arm 74 transverse to the axis A, the length of the leg 72 and the arm 74 along the axis A, the area moment of inertia of the leg 72 and the arm 74. It is to be appreciated that the leg 72 and the arm 74 may be any suitable flexural rigidity. Typically, the flexural rigidity is measured by independently applying a force to each of the leg 72 and the arm 74 transverse to and toward the axis A and determining how much force is required to deflect each of the leg 72 and the arm 74 a comparative distance. The force is applied to each of the leg 72 and the arm 74 at an equal distance from the proximal end 68. As a non-limiting example, when the first body member 64 is comprised of die-cast zinc alloy, the leg 72 and the arm 74 may deflect a comparative distance of 0.03-0.05 inches when 58 pound-force (lbf) is applied to the leg 72 and 11 lbf is applied to the arm 74. One having skill in the art will appreciate that the force required to deflect the leg 72 and the arm 74 a comparative distance may vary depending upon the material from which the first body member 64 is comprised.

Figure 5:
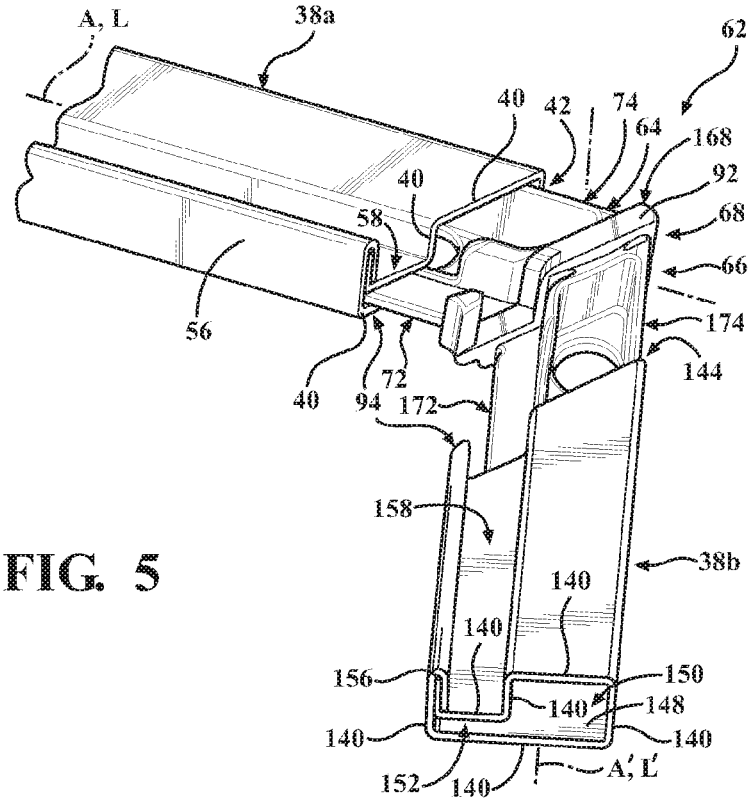
FIG. 5 is a perspective view of a first frame member and a second frame member each defining an interior void with the cornerlock, shown in FIG. 3A, partially inserted into the interior voids.
Figure 6:
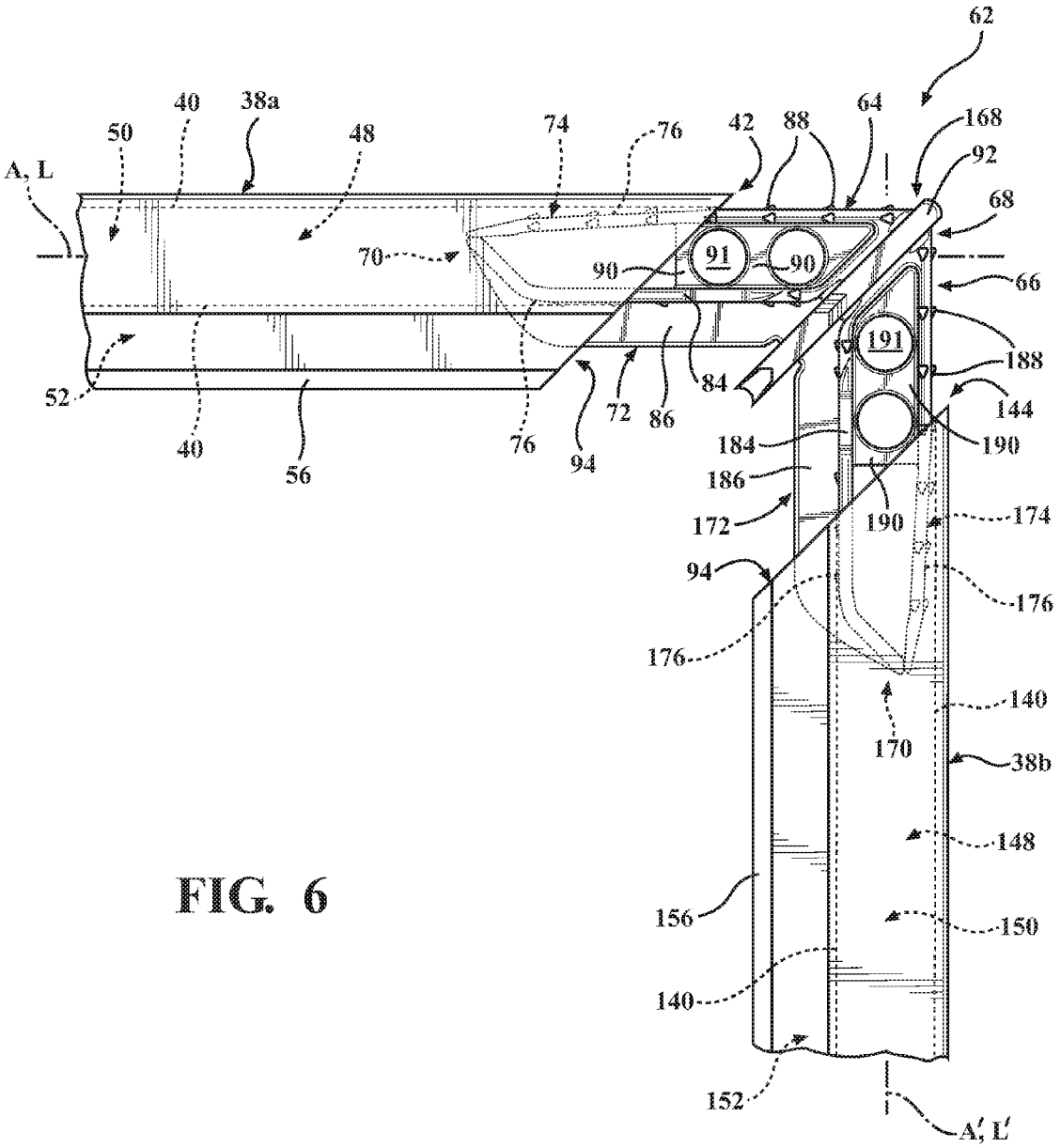
FIG. 6 is an elevational view of the first and second body members of the cornerlock, shown in FIG. 3A, partially inserted into the interior voids of the first and second frame members.
Figure 12:
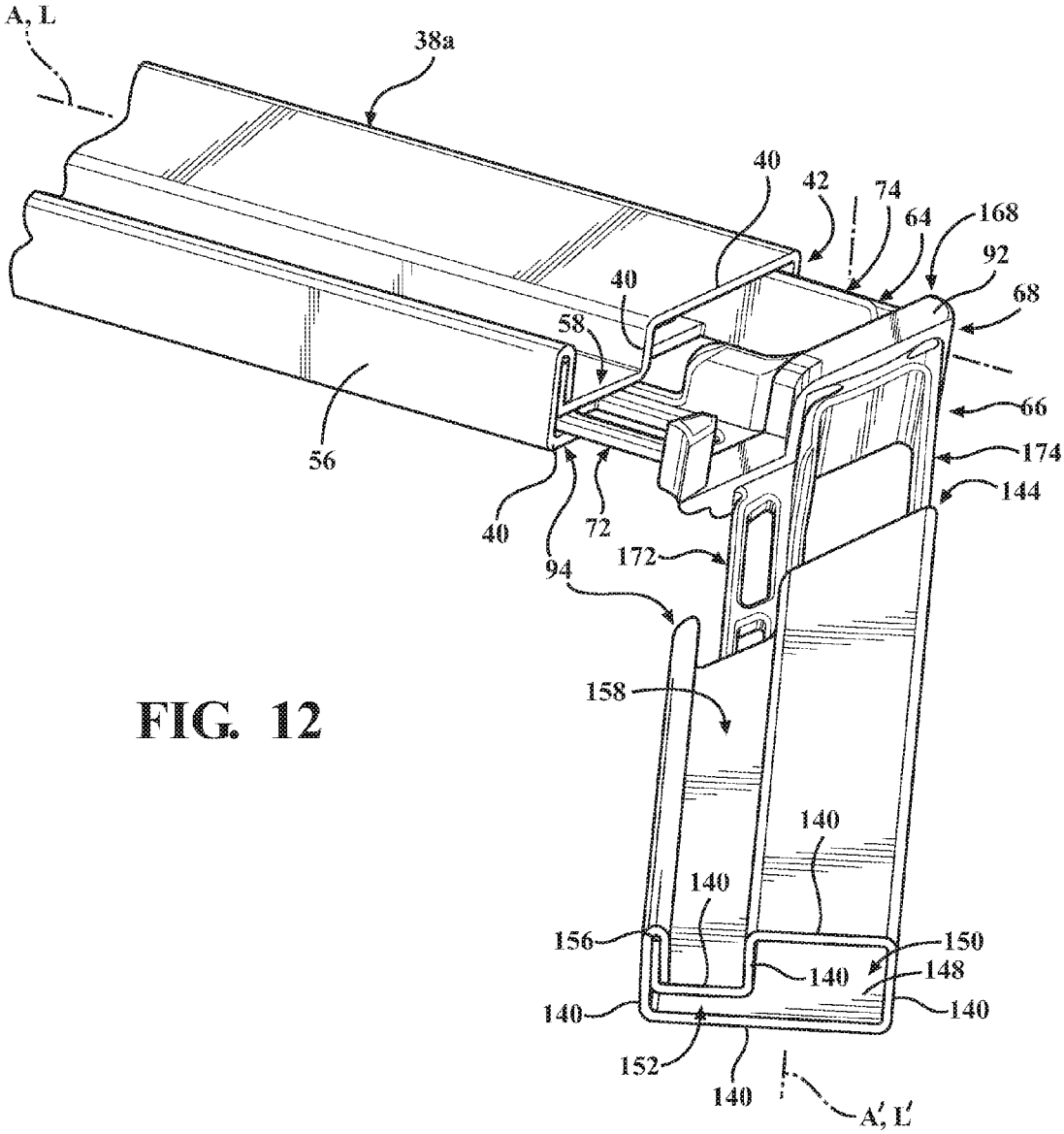
FIG. 12 is a perspective view of a first frame member and a second frame member each defining an interior void with the cornerlock, shown in FIG. 10A, partially inserted into the interior voids.
Figure 13:
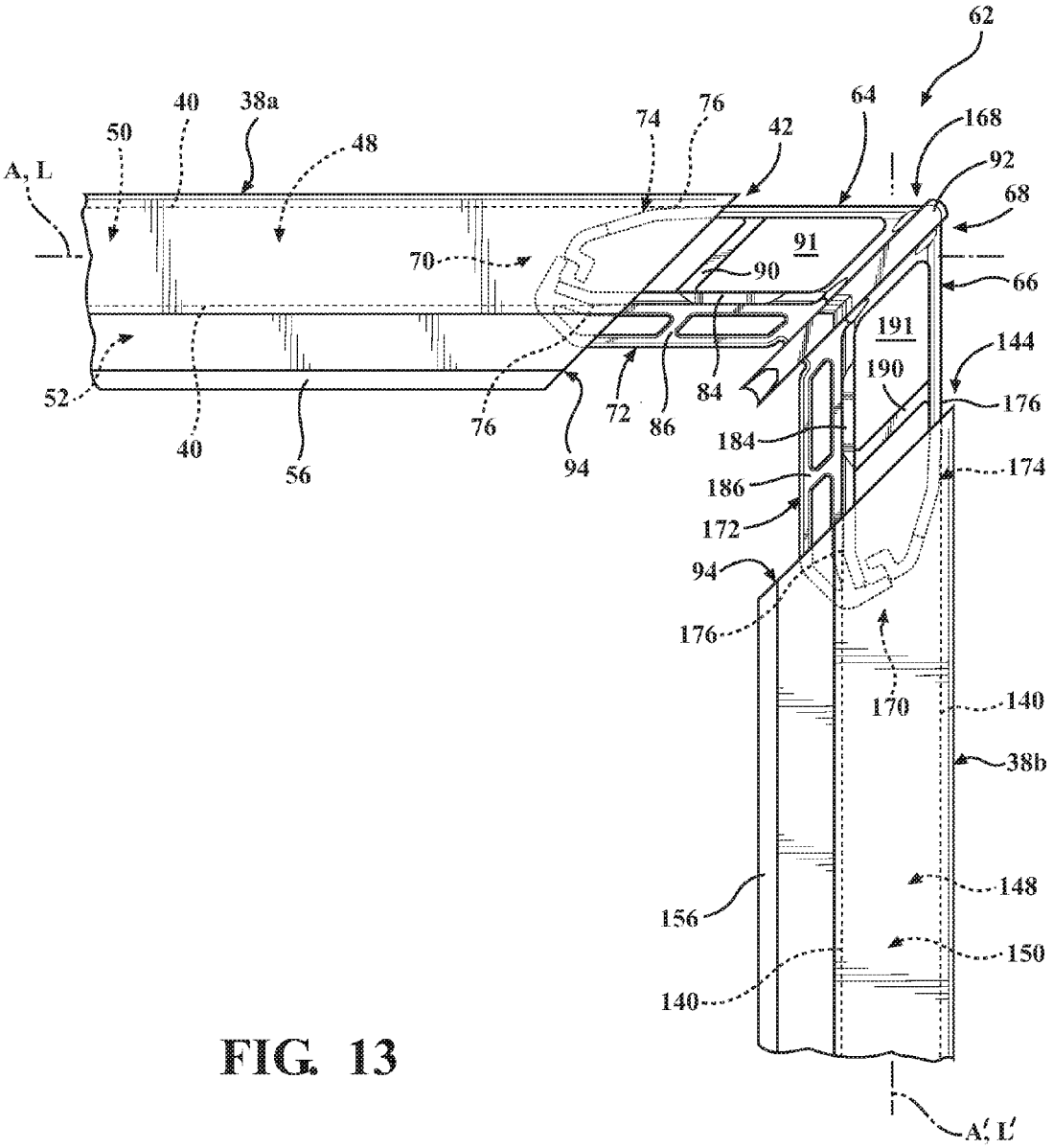
FIG. 13 is an elevational view of the first and second body members of the cornerlock, shown in FIG. 10A, partially inserted into the interior voids of the first and second frame members.

As shown in FIGS. 5 and 12, the interior void 48 of the first frame member 38*a* may be further defined as the first interior section 50 and the second interior section 52 with the first leg portion 84 disposed within the first interior section 50 and the second leg portion 86 disposed within the second interior section 52. Said differently, the first and second interior sections 50, 52 open into one another with leg 72 extending therebetween such that the first leg portion 84 is disposed in the first interior section 50 and the second leg portion 86 is disposed in the second interior section 52.

The first interior section 50 may be configured to only accept the first leg portion 84 and second interior section 52 may be configured to only accept the second leg portion 86 to facilitate and maintain proper alignment of the first body member 64 relative to the first frame member 38*a*. Said differently, the first and second interior sections 50, 52 may have a shape similar to the first and second leg portions 84, 86 and the arm 74 for accepting the first body member 64 therein (i.e. the first and second interior sections 50, 52 may have a substantially L-shaped configuration similar to the first and second leg portions 84, 86, with the first leg portion 84 and the arm 74 disposed in the first interior section 50 and the second leg portion 86 disposed in the second interior section 52). Furthermore, the first frame member 38*a* may be sized such that the leg 72 and the arm 74 may frictionally engage the walls 40 of the first frame member 38*a* within the interior void 48 with limited movement of the first body member 64 relative to the first frame member 38*a* about the axis A. Furthermore, the first frame member 38*a* may define the channel 58 such that the first and second leg portions 84, 86 partially surround the channel 58. In so doing, the first and second leg portions 84, 86 may reinforce the channel 58.

Figure 4:
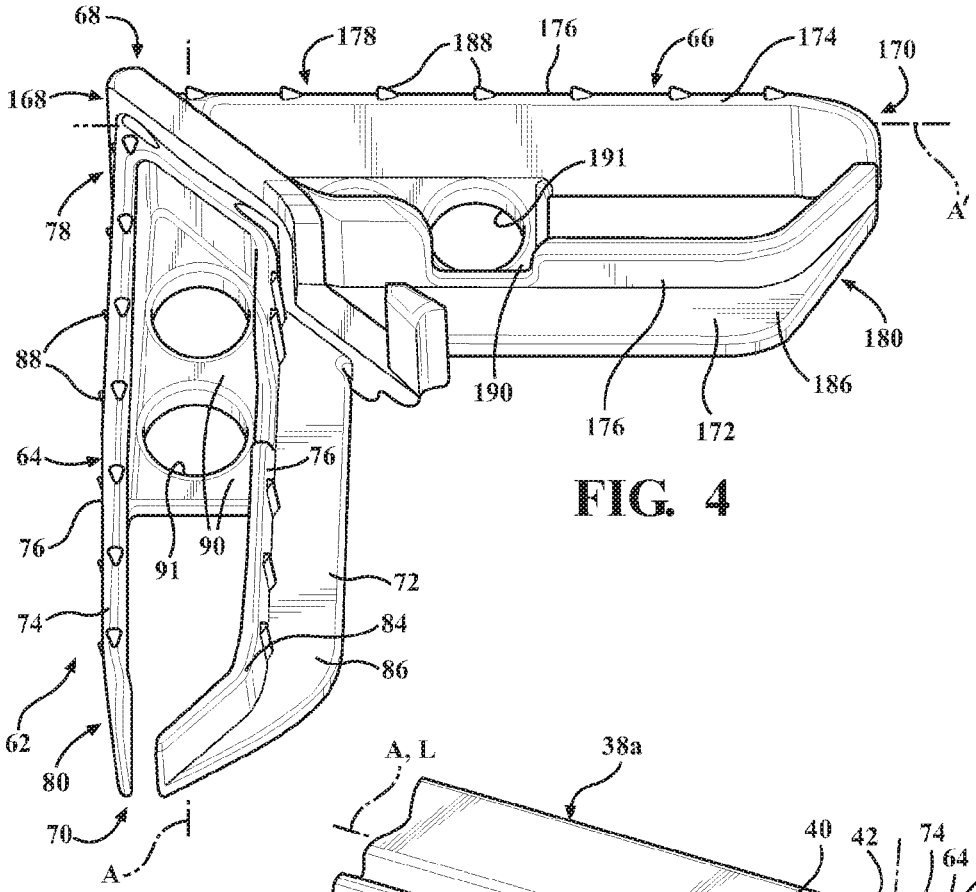
FIG. 4 is perspective view of the cornerlock, shown in FIG. 3A, having the first and second body members.

As shown in FIGS. 3A, 4, and 15A, the first body member 64 may extend along the axis A between the proximal and distal ends 68, 70 and may have at least one rib 88 extending from the engagement surface 76 of at least one of the leg 72 and the arm 74 transverse to the axis A for engaging the first frame member 38*a* within the interior void 48 of the first frame member 38*a*. The at least one rib 88 may be further defined as a plurality of ribs 88 defined on each of the pair of engagement surfaces 76 of the leg 72 and the arm 74. As shown in FIGS. 3A, 4, and 15A, the plurality of ribs 88 may be disposed on the first leg portion 84 of the leg 72. The ribs 88 increase the frictional engagement of the leg 72 and the arm 74 with the walls 40 of the first frame member 38*a*. It is to be appreciated that the ribs 88 may be disposed on any suitable surface of the first body member 64.

As shown in FIGS. 3A, 4, 10A, 11, and 15A, the first body member 64 may have a brace 90 positioned between the proximal and the distal ends 68, 70 and extending between and coupled to each of the leg 72 and the arm 74 with the brace 90 localizing the deflection substantially toward the distal end 70, as shown in FIGS. 3B, 10B, and 15B. More specifically, the brace 90 extends between and is coupled to the proximal portion 78 of each of the leg 72 and the arm 74, spaced from the distal portion 80 of each of the leg 72 and the arm 74. The brace 90 further defines the deflection of the arm 74 about said proximal end 68. More specifically, the brace 90 localizes the deflection of the arm 74 about the proximal end 68 substantially toward the distal end 70. In doing so, the amount of deflection of the arm 74 about the proximal end 68 may be designed according to the position of the brace 90 relative the proximal end 68. More specifically, the closer the brace 90 is to the proximal end 68, the greater the amount of deflection of the arm 74. The brace 90 may at least partially define at least one void 91. As shown in FIGS. 3A and 4, the brace 90 may entirely define each of a plurality of voids 91 having a substantially circular configuration. As shown in FIGS. 10A and 11, the brace 90, the leg 72, and the arm 74 may in combination at least partially define a single void 91 having a substantially rectangular configuration. It is to be appreciated that the brace 90 and the at least one void 91 may have any suitable configuration for localizing the deflection of the arm 74 about the proximal end 68.

Figure 8:
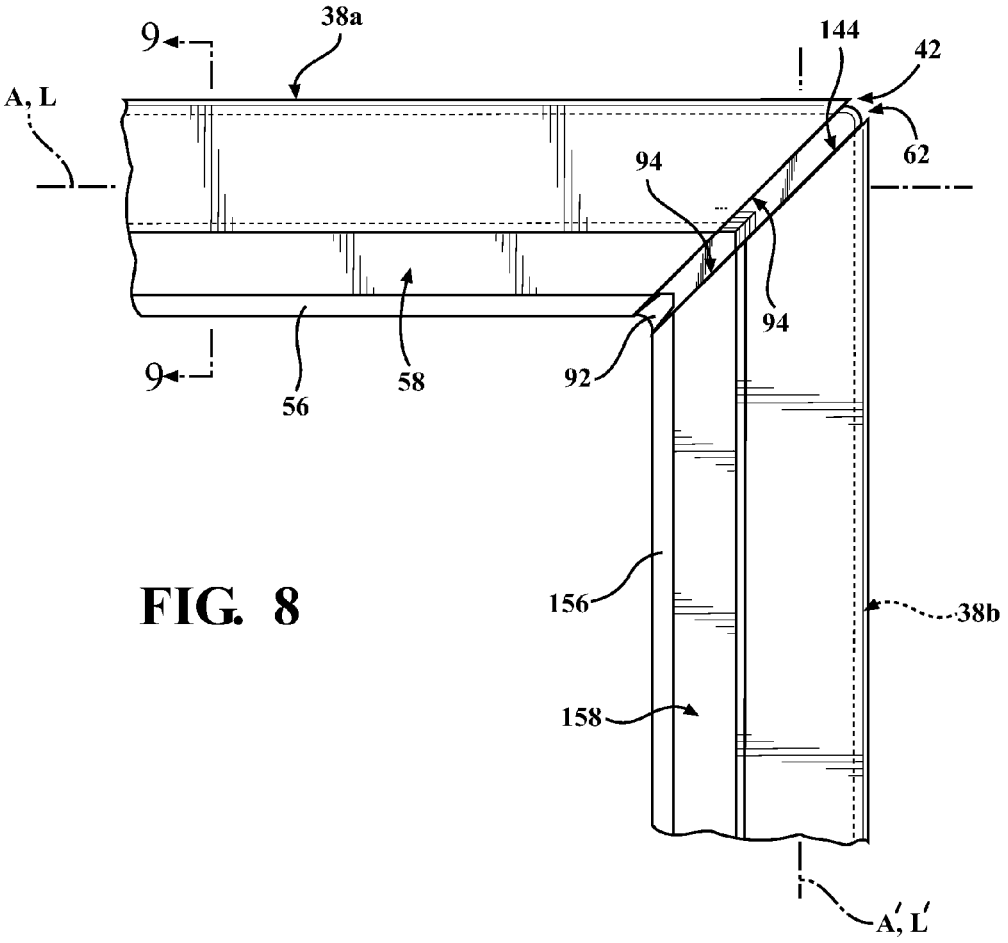
FIG. 8 is an elevational view of the first and second frame members abutting a center wall of a cornerlock.

As shown in FIGS. 3A, 4, 10A, 11, and 15A, the corner-lock 62 may include a center wall 92 at the proximal end 68 of each of the first and second body members 64, 66 and extending transverse to the leg 72, with the center wall 92 abutting at least one of the first and second ends 42, 44, 142, 144 of each of the first and second frame members 38*a*, 38*b* (as shown in FIG. 8). In other words, one or both of the first and second frame members 38*a*, 38*b* may abut the center wall 92 at either of the first ends 42, 142 and the second ends 44, 144. The center wall 92 may extend from the leg 72 along a plane transverse to the leg 72 and abutting one of the first and second ends 42, 44, 142, 144 of each of the first and second frame members 38*a*, 38*b*. The center wall 92 may extend from the proximal end 68 of each of the first and second body members 64, 66 radially about the axis A. The center wall 92 may have a substantially rectangular cross-section transverse to the axis A such that the center wall 92 has a consistent thickness about the axis A. The center wall 92 may be disposed at the center of the angle R formed between the first and second body members 64, 66.

Figure 7:
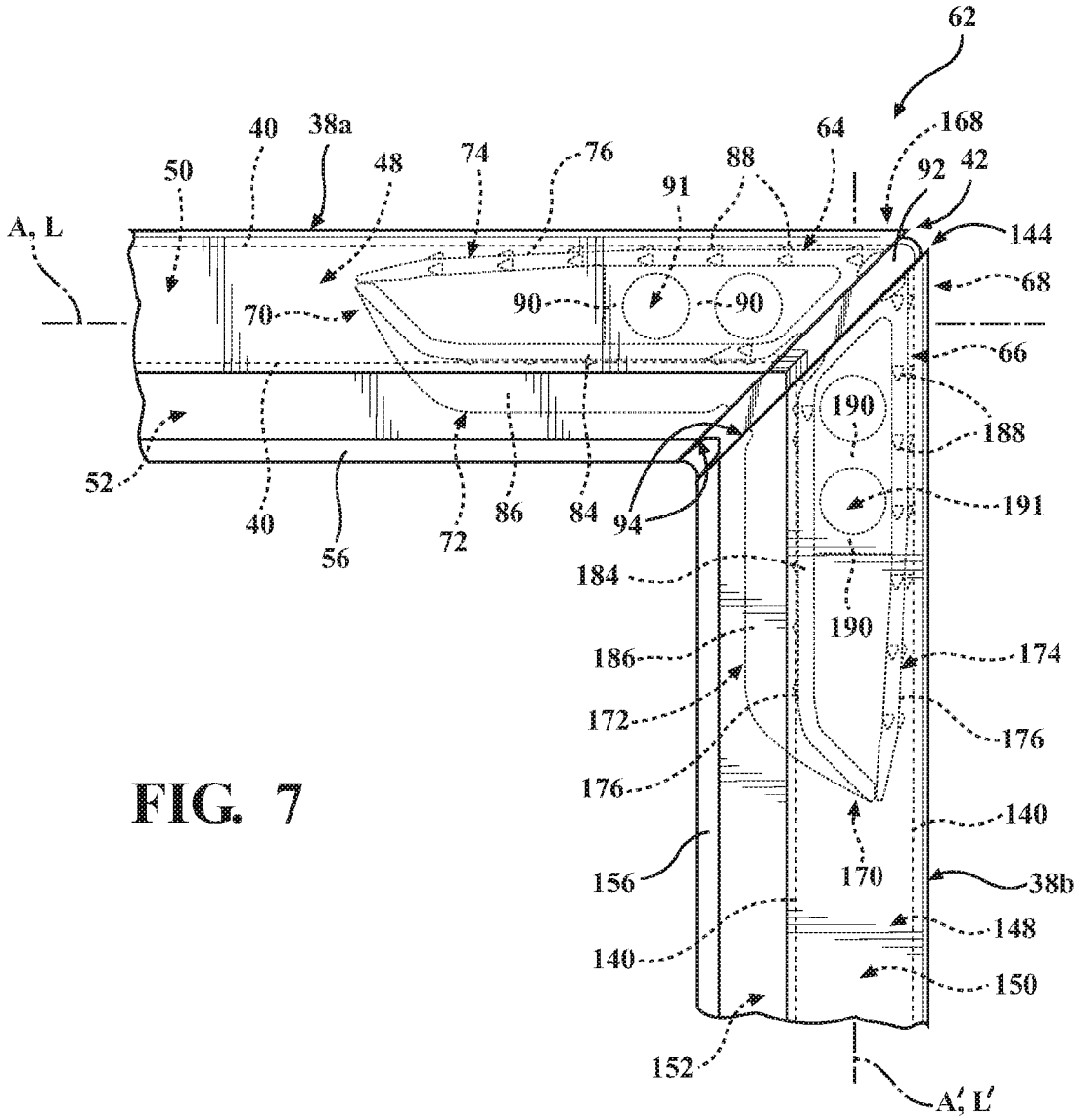
FIG. 7 is an elevational view of the first and second body members of the cornerlock, shown in FIG. 3A, inserted into the interior voids of the first and second frame members and the first and second frame members having mitered ends abutting a center wall of the cornerlock.

As shown in FIGS. 7, 8, and 14, each of the first and second frame members 38*a*, 38*b* may have a mitered end 94 with the cornerlock 62 extending into the interior voids 48, 148 of the first and second frame members 38*a*, 38*b* at the mitered ends 94, and with the first and second frame members 38*a*, 38*b* abutting the center wall 92 at the mitered ends 94 in an angular configuration. The cornerlock 62 extends into the interior voids 48 of the first and second frame members 38*a*, 38*b* at the mitered ends 94. The first and second frame members 38*a*, 38*b* abut at the mitered ends 94 in an angular configuration. The center wall 92 may have an outer profile along the axis A which is substantially equal to an outer profile of the first and second frame members 38*a*, 38*b* so the center wall 92 and the first and second frame members 38*a*, 38*b* form and uniform, continuous exterior surface. In doing so, the frame assembly 20 has a uniform, aesthetic transition between the first and second frame members 38*a*, 38*b*. The first and second frame members 38*a*, 38*b* may be painted and cut to form the mitered end 94. The abutment of the mitered ends 94 of the first and second frame members 38*a*, 38*b* with the center wall 92 prevents exposed burrs from cutting the mitered ends 94 as well as the exposure of the unpainted cut surfaces of the mitered ends 94, which is aesthetically unappealing.

As shown in FIGS. 15A and 15B, the second body member 66 may have a unitary design such that the second body member 66 has a single leg 172 extending from the proximal end 168 to the distal end 170 disposed in the interior void 148 of the second frame member 38*b*, but does not have the arm. Alternatively, as shown in FIGS. 3A-7 and 10A-14, the second body member 66 may have a leg 172 extending from the proximal end 168 to the distal end 170 and may be resistant to deflection and may also have an arm 174 spaced from the leg 172 and extending from the proximal end 168 to the distal end 170. The arm 174 may be deflectable about the proximal end 168. The arm 174 may be configured to immediately deflect upon engagement with the second frame member 38*b* for engaging the leg 172 with one of the plurality of walls 40 and biasing the arm 174 into engagement with another one of the plurality of walls 40 of the second frame member 38*b* within the interior void 148 of the second frame member 38*b* such that the second body member 66 self-configures to the second frame member 38*b*. As such, the second body member 66 may be configured similarly to the first body member 64 as described above. Therefore, the description of the first body member 64 above may be applied to the second body member 66. Furthermore, in the Figures, components of the second body member 66 that are identical or similar to components of the first body member 64 have the same reference numerals increased by 100. In addition, in the Figures, the axis which the second body member 66 extends along, which is similar to the axis A of the first body member 64, is shown at A'.

Accordingly, it is the deflection of the arm 74 caused by engagement with the first frame member 38*a* that facilitates the bias exerted by the arm 74 against the first frame member 38*a*, which increases a frictional force between leg 72 and the arm 74 of the first body member 64 with the first frame member 38*a* and retains the first body member 64 in the interior void 48 of the first frame member 38*a*. Furthermore, the extension of the arm 74 from the proximal end 68 to the distal end 70 provides the appreciable benefit of movement of the arm 74 at the distal end 70 which facilitates insertion of the first body member 64 into varying cross-sections of the interior void 48 of the first frame member 38*a* immediately upon insertion, rather than after a substantial portion of the first body member 64 has been inserted into the first frame member 38*a*. In addition, the deflection of the arm 74 allows the first body member 64 to self-configure to the cross-section of the first frame member 38*a*, which simplifies the skill and labor needed to assemble the frame assembly 20. Further, the self-configuration of the first body member 64 facilitates retention of the first body member 64 with frame assemblies of all different designs.

The invention has been described in an illustrative manner, and it is to be understood that the terminology which has been used is intended to be in the nature of words of description rather than of limitation. As is now apparent to those skilled in the art, many modifications and variations of the subject invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A cornerlock for use with a frame assembly, with the frame assembly including a first frame member and a second frame member each having a plurality of walls extending between a first end and a second end which is spaced from the first end, with the plurality of walls of each of the first and second frame members defining an interior void, and with said cornerlock configured to extend into the interior void of each of the first and second frame members, said cornerlock comprising:

a first body member configured to mate with the interior void of the first frame member; and a second body member configured to mate with the interior void of the second frame member, with each body member having a proximal end and a distal end spaced from said proximal end with said first and second body members rigidly fixed to one another at said proximal ends;

wherein said first body member has a leg extending from said proximal end to said distal end with said leg resistant to deflection, and said first body member also has an arm spaced from said leg and extending from said proximal end to said distal end, with said arm deflectable about said proximal end, and with said arm configured to immediately deflect upon engagement with the first frame member for engaging said leg with one of the plurality of walls and biasing said arm into engagement with another one of the plurality of walls of the first frame member within the interior void of the first frame member such that said first body member self-configures to the first frame member; and wherein each of said leg and said arm have an engagement surface, with said engagement surfaces facing away from one another for engaging opposing walls within the interior void of the first frame member.

2. The cornerlock as set forth in claim 1 wherein said leg has a first leg portion and a second leg portion each extending along an axis between said proximal end and said distal end, with said first leg portion having said engagement surface for engaging one of the walls within the interior void of the first frame member, and with said second leg portion extending from said engagement surface transverse to said axis to brace said first leg portion such that said leg has a greater resistance to deflection than said arm.

3. The cornerlock as set forth in claim 2 wherein said second leg portion extends from said engagement surface substantially perpendicular to said first leg portion.

4. The cornerlock as set forth in claim 1 wherein said first body member extends along an axis between said proximal and distal ends and has at least one rib extending from said engagement surface of at least one of said leg and said arm transverse to said axis for engaging the first frame member within the interior void of the first frame member.

5. The cornerlock as set forth in claim 1 wherein said leg and said arm extend spaced from and substantially parallel to each other between said proximal and distal ends with said arm deflectable toward and away from said leg.

6. The cornerlock as set forth in claim 4 wherein said leg and said arm are tapered toward each other at said distal end for facilitating insertion of said first body member into the interior void of the first frame member.

7. The cornerlock as set forth in claim 1 wherein said first body member has a brace positioned between said proximal and said distal ends and extending between and coupled to each of said leg and said arm with said brace localizing said deflection substantially toward said distal end.

8. The cornerlock as set forth in claim 1 further including a center wall at said proximal end of each of said first and second body members and extending transverse to said leg, with said center wall configured to abut at least one of the first and second ends of each of the first and second frame members.

9. The cornerlock as set forth in claim 8 wherein said center wall extends from said leg along a plane transverse to said leg for abutting one of the first and second ends of each of the first and second frame members.

10. The cornerlock as set forth in claim 1 wherein said first and second body members define an angle at said proximal ends, with said angle less than 180 degrees.

11. The cornerlock as set forth in claim 10 wherein said leg of said first body member partially defines said angle.

12. The cornerlock as set forth in claim 1 wherein said leg has a flexural rigidity at least three times greater than a flexural rigidity of said arm.

13. The cornerlock as set forth in claim 1 wherein said second body member has a leg extending from said proximal end to said distal end with said leg resistant to deflection, and said second body member also has an arm spaced from said leg and extending from said proximal end to said distal end, with said arm deflectable about said proximal end, and with said arm configured to immediately deflect upon engagement with the second frame member for engaging said leg with one of the plurality of walls and biasing said arm into engagement with another one of the plurality of walls of the second frame member within the interior void of the second frame member such that said second body member self-configures to the second frame member.

14. The cornerlock as set forth in claim 1 wherein said first body member has a first width at said proximal end and a second width at said distal end, with said second width variable with said deflection of said arm such that said second width is at most equal to said first width for facilitating immediate deflection of said arm upon engagement with the first frame member.

15. The cornerlock as set forth in claim 1 wherein said first and second body members are integral such that said cornerlock is a unitary construction.

16. A frame assembly for disposing within an opening of a structure, said frame assembly comprising:

a first frame member and a second frame member each having a plurality of walls extending between a first end and a second end which is spaced from said first end, with said plurality of walls of each of said first and second frame members defining an interior void; and a cornerlock extending into said interior void of each of said first and second frame members to couple together said first and second frame members, said cornerlock comprising:

a first body member configured to mate with said interior void of said first frame member and a second body member configured to mate with said interior void of said second frame member, with each body member having a proximal end and a distal end spaced from said proximal end with said first and second body members rigidly fixed to one another at said proximal ends;

wherein said first body member has a leg extending from said proximal end to said distal end with said leg resistant to deflection, and said first body member also has an arm spaced from said leg and extending from said proximal end to said distal end, with said arm deflectable about said proximal end, and with said arm immediately deflecting upon engagement with said first frame member to engage said leg with one of said plurality of walls and bias said arm into engagement with another one of said plurality of walls of said first frame member within said interior void of said first frame member such that said first body member self-configures to said first frame member; and wherein each of said leg and said arm have an engagement surface, with said engagement surfaces facing away from one another for engaging opposing walls within the interior void of the first frame member.

17. The frame assembly as set forth in claim 16 wherein said cornerlock includes a center wall at said proximal end of each of said first and second body members and extending transverse to said leg, with said center wall abutting one of said first and second ends of each of said first and second frame members.

18. The frame assembly as set forth in claim 17 wherein said center wall extends from said leg along a plane transverse to said leg and abutting one of said first and second ends of each of said first and second frame members.

19. The frame assembly as set forth in claim 18 wherein each of said first and second frame members have a mitered end with said cornerlock extending into said interior voids of said first and second frame members at said mitered ends, with said first and second frame members abutting said center wall at said mitered ends in an angular configuration.

20. The frame assembly as set forth in claim 16 wherein said leg of said first body member has a first leg portion and a second leg portion each extending along an axis between said proximal end and said distal end, with said first leg portion having an engagement surface engaging one of said walls within said interior void of said first frame member, and with said second leg portion extending from said engagement surface transverse to said axis to brace said first leg portion such that said leg has a greater resistance to deflection than said arm.

21. The frame assembly as set forth in claim 20 wherein said interior void of said first frame member is further defined as a first interior section and a second interior section with said first leg portion disposed within said first interior section and said second leg portion disposed within said second interior section.

22. The frame assembly as set forth in claim 21 wherein said first interior section is configured to only accept said first leg portion and second interior section is configured to only accept said second leg portion to facilitate and maintain proper alignment of said first body member relative to said first frame member.

23. A cornerlock for use with a frame assembly, with the frame assembly including a first frame member and a second frame member each having a plurality of walls extending between a first end and a second end which is spaced from the first end, with the plurality of walls of each of the first and second frame members defining an interior void, and with said cornerlock configured to extend into the interior void of each of the first and second frame members, said cornerlock comprising:

a first body member configured to mate with the interior void of the first frame member;

a second body member configured to mate with the interior void of the second frame member, with each body member having a proximal end and a distal end spaced from said proximal end with said first and second body members rigidly fixed to one another at said proximal ends; and a center wall at said proximal end of each of said first and second body members and extending transverse to said leg;

wherein said first body member has a leg extending from said proximal end to said distal end with said leg resistant to deflection, and said first body member also has an arm spaced from said leg and extending from said proximal end to said distal end, with said arm deflectable about said proximal end, and with said arm configured to immediately deflect upon engagement with the first frame member for engaging said leg with one of the plurality of walls and biasing said arm into engagement with another one of the plurality of walls of the first frame member within the interior void of the first frame member such that said first body member self-configures to the first frame member; and wherein each of said first and second body members independently extend along an axis between said proximal and distal ends, and said center wall defines a first wall surface facing said distal end of said first body member and a second wall surface substantially parallel with said first wall surface and facing said distal end of said second body member, with each of said first and second wall surfaces are oriented at an angle to their respective axis between 40 and 50 degrees, and with said center wall configured to abut at least one of the first and second ends of each of the first and second frame member such that the first and second form an angle equivalent to said angles of said first and second wall surfaces.

* * * * *